US005791071A

United States Patent [19]

Rosdail

[11] Patent Number: 5,791,071

[45] Date of Patent: Aug. 11, 1998

[54] CRUCIFORM GOLF SPIKE CONSTRUCTION

[76] Inventor: Dustun A. Rosdail, 420 Herald Harbor Rd., Crownsville, Md. 21032

[21] Appl. No.: 845,907

[22] Filed: Apr. 28, 1997

[51] Int. Cl.[6] ..... A43B 5/00; A43C 15/00

[52] U.S. Cl. ..... 36/134; 36/67 R; 36/67 D

[58] Field of Search ..... 36/67 R, 67 A, 36/67 B, 67 C, 67 D, 134

[56] References Cited

U.S. PATENT DOCUMENTS

| | | | |
|---|---|---|---|
| 39,575 | 8/1863 | Hyatt et al. | 36/67 D |
| 180,578 | 8/1876 | Gunsalus | 36/67 R |
| D. 288,262 | 2/1987 | Yokoishi | D2/317 |
| 294,829 | 3/1884 | West | 36/67 D |
| D. 372,355 | 8/1996 | Deacon et al. | D2/962 |
| D. 373,675 | 9/1996 | McMullin | D2/962 |
| D. 375,192 | 11/1996 | Bathum | D2/962 |
| 2,061,963 | 11/1936 | Gabriele | 36/59 R |
| 2,459,610 | 1/1949 | Zadina | 36/67 D |
| 4,014,114 | 3/1977 | Jordan et al. | 36/67 D |
| 4,651,448 | 3/1987 | Chen | 36/134 |
| 4,667,422 | 5/1987 | Yamaguchi | 36/67 A |
| 4,723,366 | 2/1988 | Hagger | 36/134 |
| 4,783,913 | 11/1988 | Aoyama | 36/134 |
| 5,029,405 | 7/1991 | DeHaitre | 36/134 |
| 5,367,793 | 11/1994 | Deacon et al. | 36/127 |

FOREIGN PATENT DOCUMENTS

| | | | |
|---|---|---|---|
| 524861 | 1/1993 | European Pat. Off. | 36/134 |
| 91/03183 | 3/1991 | WIPO | 36/67 D |
| 93/003642 | 3/1993 | WIPO | 36/134 |

*Primary Examiner*—M. D. Patterson
*Attorney, Agent, or Firm*—Henderson & Sturm

[57] ABSTRACT

A golf spike construction 10 including a generally cruciform golf spike member 20 having four arm elements 21. The outboard ends of each of the arm elements 21 are provided with a downwardly depending cleat portion 25 and the sides of the diametrically opposed arm elements 21 are further provided with recesses 26 adapted to engage the prongs 101 of a golf spike installing tool 100 to impart rotation to the golf spike member 20.

3 Claims, 1 Drawing Sheet

CRUCIFORM GOLF SPIKE CONSTRUCTION

BACKGROUND OF THE INVENTION

1. Field of the Invention

The present invention relates to the field of golf spike cleats in general, and in particular to a generally cruciform soft golf spike construction.

2. Description of Related Art

As can be seen by reference to the following U.S. Pat. Nos. Des. 288,262; Des. 373,675; Des. 375,192; and 5,367,793, the prior art is replete with myriad and diverse soft golf spike constructions.

While all of the aforementioned prior art constructions are more than adequate for the basic purpose and function for which they have been specifically designed, they are uniformly deficient with respect to their failure to provide a simple, efficient, and practical soft golf spike construction that is both easy to install while also providing widely spaced ground engaging portions.

As most golfers are aware, while the use of soft golf spikes have become increasingly popular one of the most vexing problems associated with their use is the difficulty in installing the soft golf spikes with a conventional golf spike wrench due to the generally resilient nature of the material that the soft spike is fabricated from.

As a consequence of the foregoing situation, there has existed a longstanding need for a new and improved soft golf spike construction that would be configured and designed to be readily engaged by a conventional spike wrench to facilitate the installation and removal of the spike construction on the bottom of a golf shoe and the provision of such a construction is a stated objective of the present invention.

BRIEF SUMMARY OF THE INVENTION

Briefly stated, the golf spike construction that forms the basis of the present invention comprises in general a golf spike member having a generally cruciform configuration. Each of the outwardly projecting arm elements of the golf spike member have a generally arcuate upper surface and a generally flat lower central surface.

In addition, each of the outboard ends of the arm elements have a downwardly depending cleat element which form the ground engaging elements of the golf spike construction.

Furthermore, as will be explained in greater detail further on in the specification, the generally cruciform configuration of the golf spike construction dispenses with the need for special apertures in the golf spike member to receive the prongs of a conventional golf spike wrench. This is due to the fact that each of the arm elements of the golf spike member are dimensioned to engage the prongs of the spike wrench at a variety of locations along their length to either install or remove the golf spike member with respect to the user's golf shoes.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
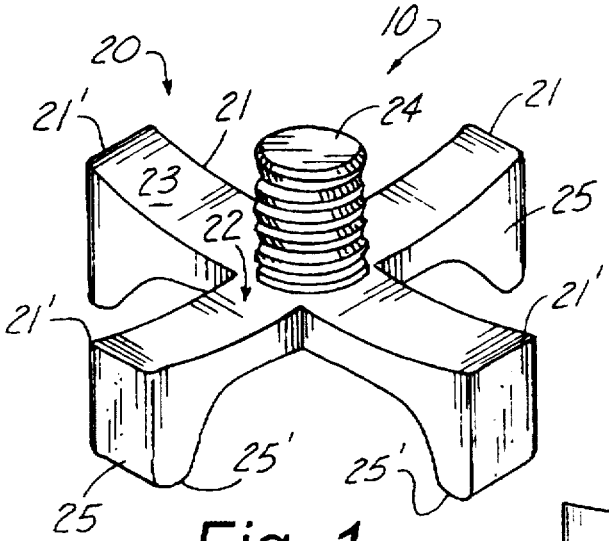
FIG. 1 is a perspective view of the cruciform golf spike construction that forms the basis of the present invention.

As can be seen by reference to the drawings, and in particularly to FIG. 1, the cruciform golf spike construction that forms the basis of the present invention is designated generally by the reference number 10. The golf spike construction comprises in general, a golf spike member 20 having a generally cruciform configuration provided by four identical contoured arm elements 21 which are equally spaced around and project outwardly from the central portion 22 of the golf spike member 20 which is formed by the juncture of all of the contoured arm elements 21.

Figure 2:
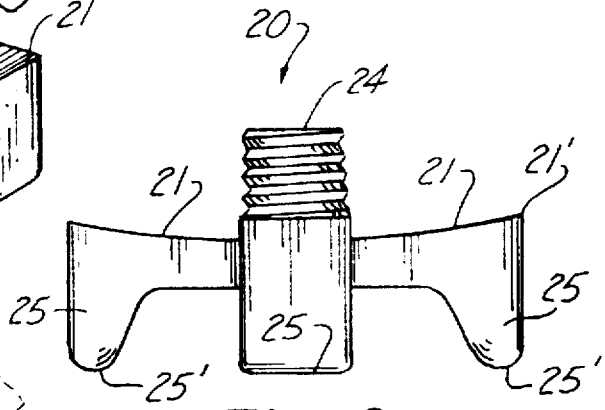
FIG. 2 is a side plan view of the golf spike construction.
Figure 3:
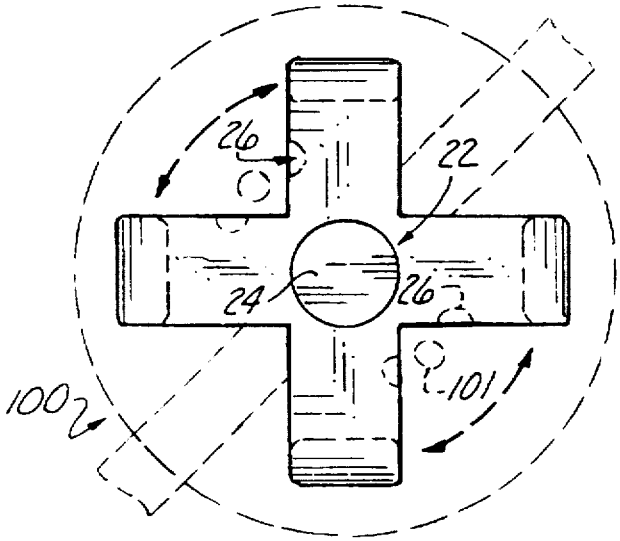
FIG. 3 is a top plan view of the golf spike construction.

As can best be seen by reference to FIGS. 1 through 3, the upper surface 23 of each of the arm elements 21 are arcuately curved upwardly relative to the central portion 22 of the spike member 20 and surround a threaded stud 24 which projects upwardly from the central portion 22 of the spike member 20 to engage the spike member 20 to the bottom of a conventional golf shoe (not shown) in a well recognized manner.

Figure 4:
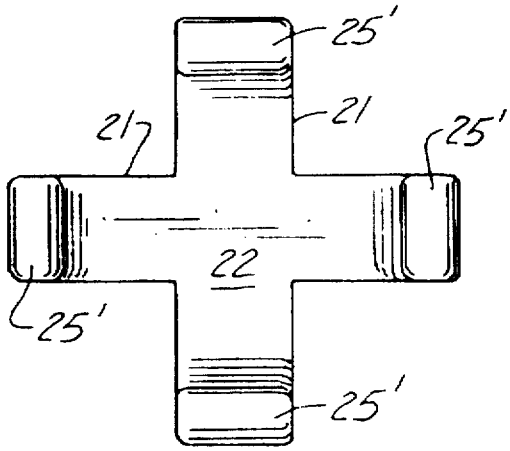
FIG. 4 is a bottom plan view of the golf spike.

Turning now to FIGS. 2 through 4, it can be seen that the outboard ends 21 of each of the arm elements 21 are provided with downwardly depending tapered cleat elements 25. In addition, as shown in FIGS. 2 and 4, both the bottom of the inboard ends of the arm elements 21 and the bottom of the central portion 22 of the spike construction 20 are flat such that the bottom of the cleat elements 25 form the rounded ground engaging portion 25 of the golf spike construction 20.

As can best be seen by reference to FIG. 3, the cruciform configuration of the golf spike construction 10 is specifically designed to cooperate with the prongs 101 in the head of a conventional golf spike installing tool 100 depicted in phantom.

Whereas, virtually all of the prior art spike constructions are required to have a plurality of holes to accept the prongs 101 of the installing tool 100, the present invention does not due to the fact that the prongs 101 can engage the opposite sides of diametrically aligned arm elements 21 for rotating the spike construction in either a clockwise or counterclockwise fashion.

In addition, as shown in FIG. 3, this invention also contemplates the provision of one or more registration recesses 26 depicted in phantom on one or both of the sides of at least two diametrically opposed arms 21. The recesses 26 are dimensioned to receive a portion of the prongs 101 of the installing tool 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A soft golf spike construction for golf shoes wherein the golf spike construction comprises:

a golf spike member having a central portion and a generally cruciform configuration provided by four arm elements which project outwardly from the central portion of the spike member, which is further provided with a threaded stud; wherein each of the arm elements have outboard ends which are provided with a downwardly depending cleat element having a rounded ground engaging portion wherein the ground engaging portion of the cleat elements are disposed parallel to the outboard ends of the arm elements, the upper portion of each of the arm elements are curved outwardly relative to said threaded stud, and the bottom of the inboard end of each of the arm elements and the bottom of the central portion of the spike member are generally flat.

2. The soft golf spike construction as in claim 1 wherein the opposite sides of at least one pair of diametrically opposed arm elements are provided with recesses dimensioned to receive a portion of the prongs of the conventional spike installing tool.

3. A soft golf spike construction for golf shoes wherein the golf spike construction consists of:

a golf spike member having a central portion and a generally cruciform configuration provided by four arm elements which project outwardly from the central portion of the spike member, which is further provided with a threaded stud; and wherein each of the arm elements have outboard ends which are provided with a downwardly depending cleat element, having a rounded ground engaging portion wherein the ground engaging portion of the cleat elements are disposed parallel to the outboard ends of each of the arm elements, the upper portion of each of the arm elements are curved outwardly and upwardly relative to said threaded stud, and wherein the bottom of the inboard end of each of the arm elements and the bottom of the central portion of the spike member are generally flat.

* * * * *